US009248934B2

(12) United States Patent
Halimun

(10) Patent No.: US 9,248,934 B2
(45) Date of Patent: Feb. 2, 2016

(54) RECLOSABLE PACKAGING CONTAINER FOR POWDER OR GRANULAR MATERIALS

(71) Applicant: Rudy Halimun, Jakarta (ID)

(72) Inventor: Rudy Halimun, Jakarta (ID)

( * ) Notice: Subject to any disclaimer, the term of this patent is extended or adjusted under 35 U.S.C. 154(b) by 64 days.

(21) Appl. No.: 14/163,879

(22) Filed: Jan. 24, 2014

(65) Prior Publication Data

US 2015/0210422 A1 Jul. 30, 2015

(51) Int. Cl.

| | |
|---|---|
| ***B65D 5/38*** | (2006.01) |
| ***B65D 17/50*** | (2006.01) |
| ***B65D 5/72*** | (2006.01) |
| *B65D 83/04* | (2006.01) |

(52) U.S. Cl.

CPC ..... *B65D 5/728* (2013.01); *B65D 83/0481* (2013.01)

(58) Field of Classification Search

USPC ..... 229/125.12, 220, 129.1, 125.125; 206/468, 267; 220/345.1

See application file for complete search history.

(56) References Cited

U.S. PATENT DOCUMENTS

| | | | | |
|---|---|---|---|---|
| 2,387,640 | A * | 10/1945 | Bouchelle | 222/561 |
| 4,279,373 | A * | 7/1981 | Montealegre | 206/0.5 |
| 8,100,321 | B2 * | 1/2012 | Ghini et al. | 229/129.1 |

* cited by examiner

*Primary Examiner* — Christopher Demeree

(57) ABSTRACT

A packaging container for dry granular products includes a rectangular container body, and a rectangular cover defining a sleeve surrounding the container body in sliding engagement, both of folded sheet material. The container body having a first pair of opposed width defining sides, a second pair of opposed height defining sides, and a third pair of opposed length defining sides perpendicular to the width and height defined by the first and second pairs of opposed sides. The container body has at least one product discharge opening in second pairs of opposite sides. The cover is slidable over the first and second pairs of opposed sides of the container body between a closed position in which the cover overlies at least one product discharge opening and an open position in which at least one product discharge opening is partially exposed by the cover.

36 Claims, 3 Drawing Sheets

RECLOSABLE PACKAGING CONTAINER FOR POWDER OR GRANULAR MATERIALS

TECHNICAL FIELD

The invention relates to a packaging container for dry granular products. More in particular the invention relates to a reclosable packaging container for storing and dispensing powdery or granular materials. The packaging container according to the invention can also be popularly referred to as a Slide-and-Tap container.

BACKGROUND ART

Containers for powder in the market are generally made as a small pouch, or formed from aluminum foil (sachet), but these containers do not have adequate open and close mechanisms. Container material, besides aluminium foil sachets, powder or granular containers are also commonly made of plastic or glass. Product content leaks easily out of these sachet containers, or they are difficult to carry when in the form of glass or plastic bottles or jars. A better design is needed for individuals who have high mobility, which requires a practical small powder container that can be opened and closed without leakage.

Container shape and container size should preferably be made relatively small to facilitate easy delivery, especially for "on line" business, but still easy, safe and convenient to carry.

DISCLOSURE OF THE INVENTION

Accordingly it is an object of the invention to reduce or eliminate at least one of the problems of the prior art, or to offer at least a useful alternative. Another object of this invention is to improve the function and practicality for users, compared to other available commercial containers.

To this end a packaging container for a dry granular product is provided as defined by one or more of the appended claims. In particular the packaging container according to the invention includes one or more of the following features: a rectangular container body of folded sheet material having a first pair of opposed sides defining a width, a second pair of opposed sides defining height, and a third pair of opposed sides defining a length perpendicular to the width and height defined by the first and second pairs of opposed sides; and a rectangular cover of folded sheet material defining a sleeve surrounding the first and second pairs of opposed sides of the container body in sliding engagement, wherein the container body has at least one product discharge opening in one side of one of the first and second pairs of opposite sides, and wherein the cover is slidably movable between a closed position in which the cover overlies the at least one product discharge opening and an open position in which the at least one product discharge opening is at least partially exposed by the cover. The design of this invention is similar in shape to a larger sized matchbox, but it is purposely designed to facilitate powder material or other dry granular materials to be contained therein and to be dispensed therefrom. Because it can be made with a relatively small size and thin, it becomes practical, easy to ship, also safe and easy to carry around. The container thereby has a practical lid opening mechanism system, simply by sliding the cover lid left to right along the container body to close or open. With an open and close mechanism by sliding the cover lid, this design is intended to improve the practicality of usage.

In an embodiment of the invention the at least one discharge opening can be located on one side of one of the first and second pairs of opposite sides of the container body. Alternatively or additionally the at least one discharge opening can be located adjacent one side of the third pair of opposite sides of the container body.

At least two opposite sides of one of the first and second pairs of opposite sides can have two full layers of sheet material. Additionally the at least two opposite sides with double layers of sheet material may include the side with the at least one product discharge opening. Alternatively or additionally one side in addition to the at least two opposite sides with double layers of sheet material can have a partial double layer. The partial double layer can be in one of the first pair of sides.

Furthermore the cover can have a partial double layer on a side confronting the one of the first pair of sides of the container having the partial double layer.

For less pressure at the middle of container, but still tight at end of the container, the confronting partial double layers can each be formed by a substantially semi-circular cut-out that extends inwardly from a free longitudinal edge of a portion of the sheet material completing the respective confronting sides of the container body and the cover. This offers a convenience for sliding the cover lid component.

The packaging container can have a plurality of product discharge openings. The plurality of discharge openings can include three openings. Alternatively or additionally the plurality of product discharge openings can each be circular openings. Each circular opening can have a diameter of 3 millimeter.

At least one side of the third pair of opposed sides can have three full layers of sheet material. At least one side of the third pair of opposed sides with three full layers of sheet material can also have at least a partial fourth layer of sheet material. Alternatively or additionally both sides of the third pair of opposite sides can have at least three full layers of sheet material.

The invention includes the choice of shape, material, an open and close mechanism, and a safety seal. To prevent tampering of the content, this invention also provides a safety seal that must be opened (ripped) before the cover lid mechanism can be enabled. The packaging container may thus also have a safety seal system that must be opened (ripped) prior to dispensing the product. To this end the cover can be immobilized with respect to the container body by a tamperproof seal connecting the cover to the container body. The tamperproof seal can be a separate element, such as a sticker or like, but may also be integral with either one of the container body or cover. Advantageously the tamperproof seal is integrally formed as a tongue on the container body. Alternatively or additionally the tamperproof seal can be connected to the one side of the third pair of opposite sides of the container body adjacent the at least one discharge opening. This latter arrangement will ensure that the cover is always be secured in its closed position. The sheet material can be one of paper, carton and card board having of a weight in the region of at least 310 grams per square meter. When the containers are made of paper carton, which is environmentally friendly, they can be sturdy, stabile and do not leak when they are filled with powder or other granular materials such as sugar, salt, pepper, spices, and so forth. The selection of paper material is made to be environmentally friendly and to simplify the recycling process, but at the same time it is also economical and hygienic.

The container body can be readily filled with granular material. In that regard the granular material can be one of deodorant powder, sugar, salt, pepper, and spice.

In summary the invention has the following features and advantages:

It is uniquely designed, with a shape similar to a large matchbox. The invention allows to accommodate powder or other dry granular materials. Because it is thin and relatively small in size, it is simplifies outbound shipments (for producers) and it is convenient and practical to carry around (for consumers).

The container has a stable shape and does not leak when filled with powder or any other granular ingredients such as sugar, salt, pepper, spice, and so forth, because:

Implementation of folding method exploit the tongue at the ends of the container, it is double layered to guard against leakage and to simplify the process of gluing after the container has been completely filled. This design is also equipped with a retaining tongue.

The design applies double layers in both the container and the cover lid components. This is done to fortify the design to prevent deformation.

The curved cut pattern both on container and on the cover lid components of the container helps to smooth the sliding motion of the cover lid without sacrificing the tight fit of the container. This particular design maintains the anti leakage function.

The container has a practical lid opening mechanism system. By utilizing the cover lid component, the container has a simple open and close mechanism. Simply slide the cover lid component to the left to close, and slide it to the right to open the container.

The design has a security system. It has a safety seal that is useful both for producers and consumers. This safety seal must be opened (ripped) prior to product release. Safety seal is included in part of the container component that is glued to the cover lid component.

BRIEF DESCRIPTION OF THE DRAWINGS

These and other useful features of the invention will now be described in further detail and by way of example by reference to the accompanying drawings in which.

DETAILED DESCRIPTION OF THE PREFERRED EMBODIMENTS OF THE INVENTION

Figure 1:
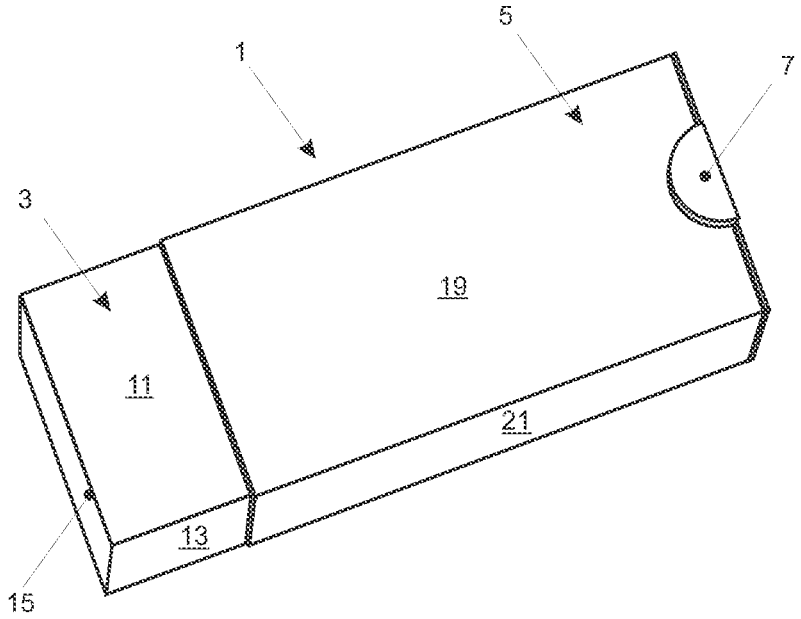
FIG. 1 is a perspective view of a packaging container according to the invention shown in a closed and sealed condition.
Figure 2:
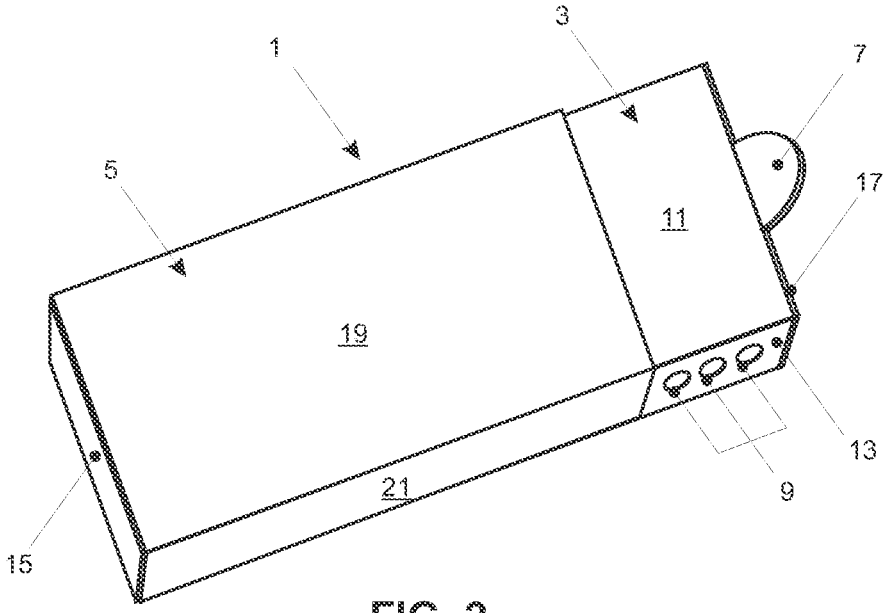
FIG. 2 is a perspective view of the packaging container of FIG. 1 shown in an opened condition with a broken seal.

In FIG. 1 a packaging container 1 according to the invention is shown to include a rectangular container body 3 and a rectangular cover 5. The cover 5 is formed as a sleeve that engages around the container body 3. The cover 5 as shown in FIG. 1 is prevented from sliding about the container body 3 by means of a tamperproof seal 7, which secures the sleeve-like cover 5 to the container body 3. The packaging container 1 in FIG. 2 is shown with the seal 7 broken and the cover 5 slid about the container body 3 to an open position revealing product discharge openings 9. As further seen in FIG. 2 the rectangular container body 3 has a pair of opposite width defining first and second sides, of which a first width defining side is indicated by numeral 11. Similarly a first one of a pair of first and second height defining sides is indicated by numeral 13. A pair of opposite first and second end sides 15, 17 defines a length of the container body 3. As will be described herein below the container body 3 is formed of folded sheet material, such as paper board. The rectangular cover 5 is similarly formed of folded sheet material and includes a further pair of first and second width defining sides, with a first one indicated by reference 19, as well as a further pair of first and second height defining sides, with a first one 21 visible in FIGS. 1 and 2.

Figure 3:
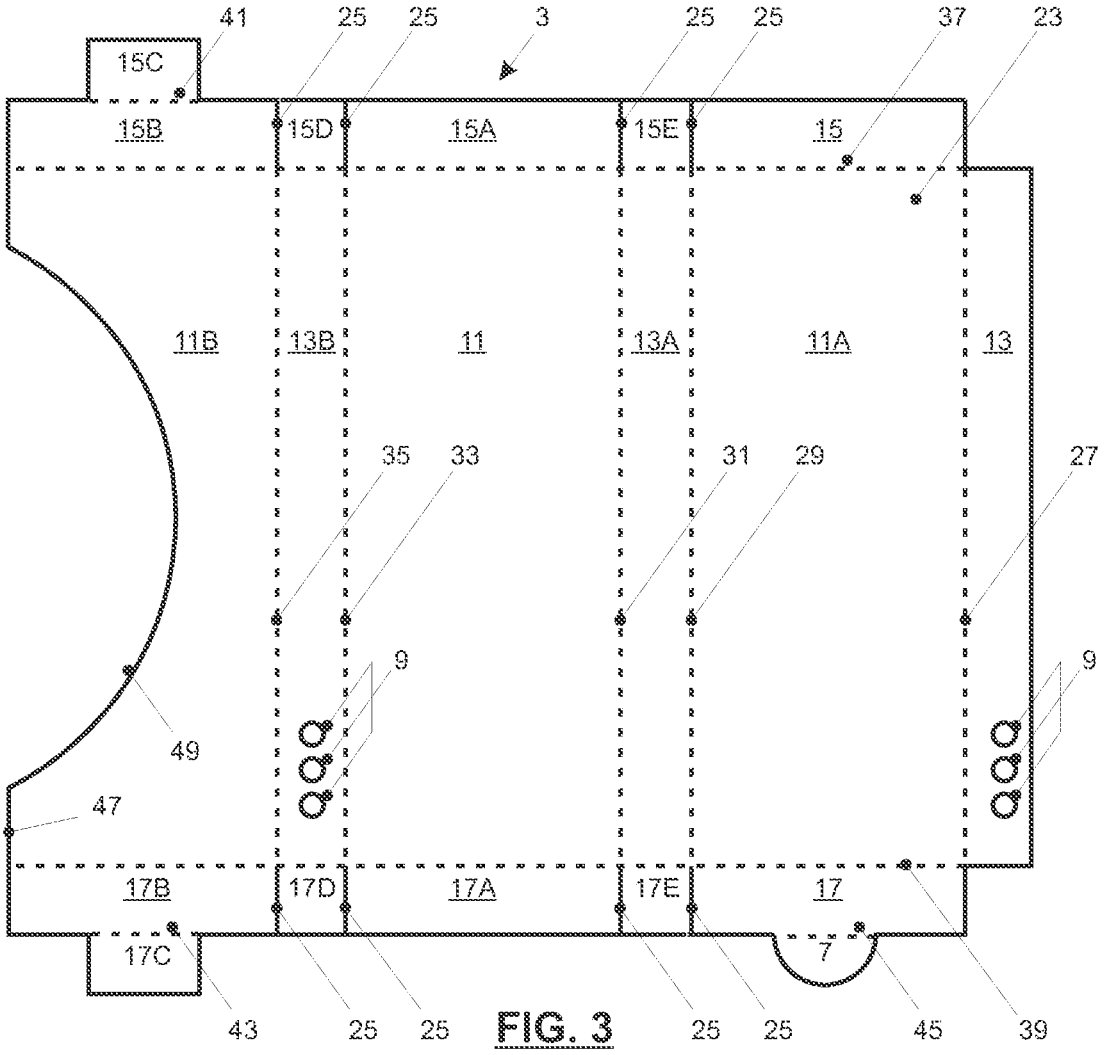
FIG. 3 is a plano for forming a container body of the packaging container of the invention.

In FIG. 3 is shown a first blank 23 of sheet material for forming the container body 3. A suitable sheet material for forming the container body 3 is paper card board or carton having a weight in the region of at least 310 grams per square meter. This type of paper sheet material, which can also be laminated and/or printed, has been found useful for container packages having a width within a range of 35-50 millimeter, a length within a range of 90-115 millimeter, and a height within a range of 10-15 millimeter. The first width defining side 11 forming one of the larger outer faces of the container body 3 is complemented by an opposite second width defining side 11A. Similarly the first height defining side 13 forming the smaller of the lateral outer faces of the container body 3 is complemented by an opposite second height defining side 13A, as well as an overlapping inner height defining panel 13B. Additionally there is also an overlapping inner width defining panel 11B, for overlapping the second width defining side 11A on an inside thereof.

The first and second end sides 15, 17 of the container body 3 are part of end walls that are each constructed of at least three full layers of sheet material by a plurality of overlapping end flaps 15A, 15B, 17A, 17B. A first intermediate end flap 15A and a second intermediate end flap 17A are each joined to the wide defining side 11. A first inner end flap 15B and a second inner end flap 17B are each joined to the inner width defining panel 11B. A further intermediate layer of sheet material for the end walls of the container body 3 is formed by first and second supporting tab extensions 15C, 17C. The further intermediate layer of the end walls is completed by a first pair of inwardly folding side tabs 15D, 15E and a second pair of inwardly folding side tabs 17D, 17E. The individual tabs 15D, 15E, 17D, 17E of the first and second pairs of inwardly folding tabs are each cut free of the end flaps and end sides by slits 25, which are cut through the sheet material of blank 23. A first longitudinal line 27 extends between the height defining side 13 and the opposite second width defining side 11A. A second longitudinal fold line 29 extends between the opposite width defining side 11A and the opposite height defining side 13A. A third longitudinal fold line 31 extends between the opposite height defining side 13A and the width defining side 11. A fourth longitudinal fold line 33 extends between the width defining side 11 and the overlapping inner height defining panel 13B. A fifth longitudinal fold line 35 extends between the overlapping inner height defining panel 13B and the overlapping inner width defining panel 11B. A first transverse fold line 37 extends between the sides and panels 11-13B, and the flaps and tabs 15-15E. A second transverse fold line 39 extends between the sides and panels 11-13B and the flaps and tabs 17-17E. Additional third and fourth transverse fold lines 41, 43 extend between respectively the first inner end flaps 15B and the first supporting tab extension 15C, and between the second inner end flap 17B and the second supporting tab extension 17C. An additional fifth fold line 45 is present between the second end side 17 and the tongue for forming the tamperproof seal 7. A longitudinal free edge 47 of the overlapping inner width defining panel 11B is recessed to form a substantially semi-circular cutout 49 for a purpose to be explained herein below.

Figure 4:
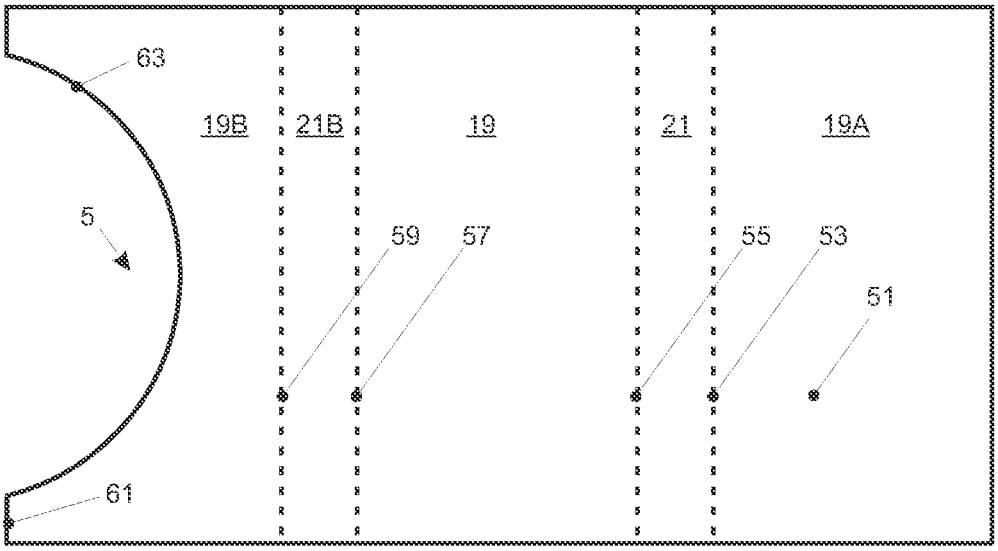
FIG. 4 is a plano for forming a cover of the packaging container of the invention.
Figure 5:
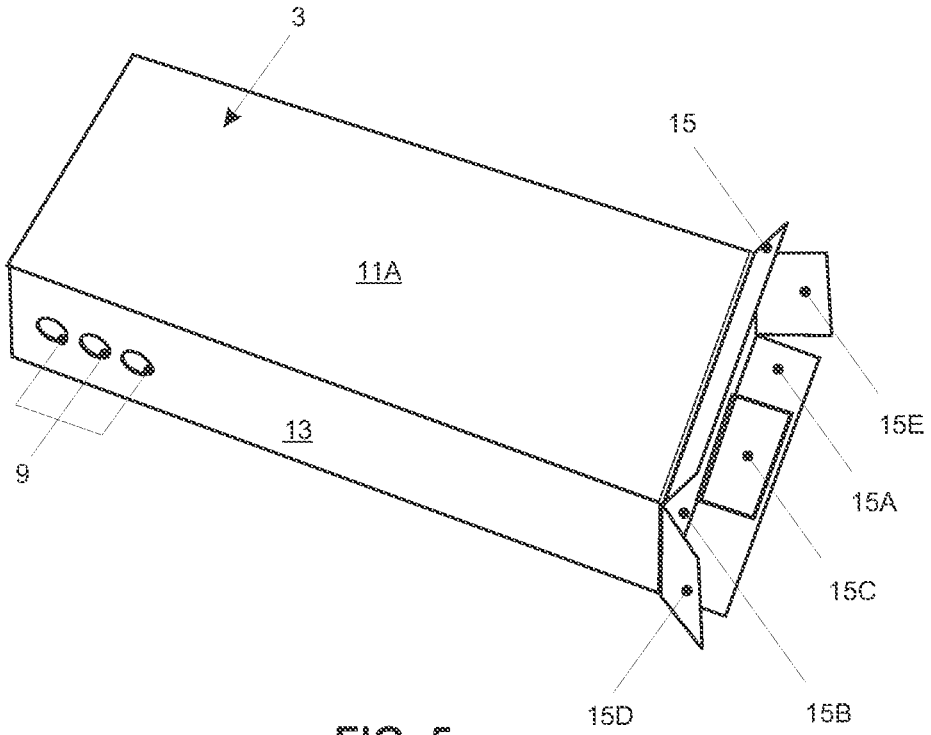
FIG. 5 is a perspective view showing a partly assembled container body in the process of being closed at a final end.
Figure 6:
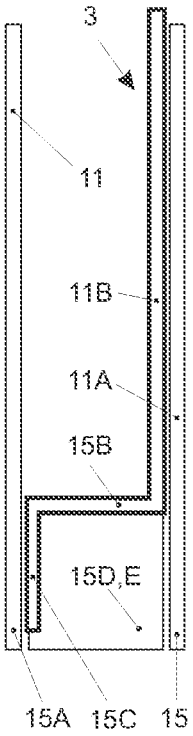
FIG. 6 is a partial cross section showing a first step of end closure.

In FIG. 4 a second blank 51 of paper board sheet material is shown for forming the cover 5. The sheet material can be identical to that of the container body blank 23. The first width defining side 19 is complemented by an opposite second width defining side 19A to form together the larger outer faces of the cover 5. Similarly the first height defining side 21 is complemented by an opposite second height defining side 21B. An overlapping additional inner width defining panel 19B is provided for overlapping the second width defining side 19A on an inside thereof. A first longitudinal fold line 53 extends between the second width defining side 19A and the first height defining side 21. A second longitudinal fold line 55 extends between the first height defining side 21 and the first width defining side 19. A third longitudinal fold line 57 extends between the first width defining side 19 and the second height defining side 21B. A fourth longitudinal fold line 59 extends between the second height defining side 21B and the overlapping additional inner width defining panel 19B. The overlapping additional inner width defining panel 19B has a longitudinal free edge 61, which is recessed to form a substantially semi-circular cutout as indicated by reference numeral 63. The substantially semi-circular cutout 63 is for a purpose yet to be described herein below.

Figure 7:
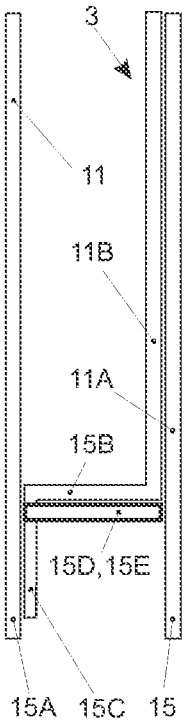
FIG. 7 is a partial cross section showing a second step of end closure.
Figure 8:
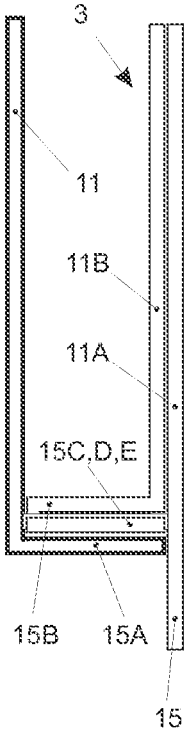
FIG. 8 is a partial cross section showing a third step of end closure.
Figure 9:
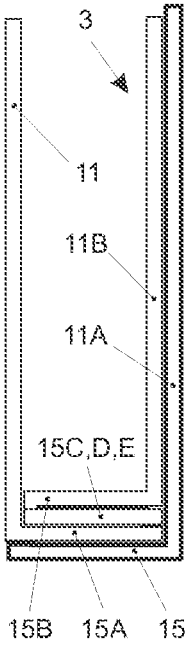
FIG. 9 is a partial cross section showing a fourth step of end closure.

The assembly of the container body 3 and its end wall construction will now be explained in reference to FIGS. 5 through 9. While the folding procedure now described relates to closing a first end of the container body 3, it is to be understood that the forming and closure of the second end wall is substantially similar. As shown in the partial cross section of FIG. 6 the opposite second width defining side 11A has been brought into overlapping relationship with the overlapping inner width defining panel 11B. Also the first inner end flap 15B has been folded to extend perpendicular between the second width defining side 11A and the first width defining side 11. The first supporting tab extension 15C to engage an inner surface of the first intermediate end flap 15A, and adhered thereto by a suitable adhesive or glue. This creates a base surface for next gluing steps. In FIG. 7 a next step of gluing the end wall is shown. In this cross section it is schematically shown that both the side tabs 15D, 15E are folded inwardly to engage and be adhered to the first inner end flap 15B. Thereupon in a further step, illustrated schematically in FIG. 8, the first intermediate end flap 15A and the first supporting tab extension 15C adhered to it earlier are folded together onto the side tabs 15D, 15E. The first supporting tab extension 15C will thereby fit between the inwardly folded side tabs 15D, 15E to effectively complete a layer of sheet material between the first inner end flap 15B and the first intermediate end flap 15A. Finally as shown in FIG. 9 the first end side 15 is folded onto the first intermediate end flap 15A and adhered thereto. This final step of folding and gluing will form a container body end wall of four layers of sheet material. The cover 5, starting from the blank of FIG. 4 is simply assembled by bringing the second width defining side 19A in overlapping relationship with the additional inner width defining panel 19B and by gluing these together.

Referring again to FIGS. 1 and 2 it will be understood that the assembled cover 5 is slid onto the container body 3 and secured thereto by the tamperproof seal tongue 7 when it is in overlapping arrangement with the product discharge openings 9. The respective substantially semi-circular cutouts 49, 63 on the inside of the second width defining sides 11A, 19A of the container body 3 and cover 5 help to reduce pressure at the middle of the width defining sides, while retaining tightness at the ends of the packaging container 1. This offers both convenience for sliding the cover and ensures sufficient friction to prevent accidental loss of the cover 5 from the container body 3, when in use.

Thus is described a packaging container 1 for a dry granular product includes a rectangular container body 3 of folded sheet material, and a rectangular cover 5 of folded sheet material defining a sleeve surrounding the container body 3 in sliding engagement. The container body 3 having a first pair of opposed width defining sides 11, 11A, a second pair of opposed height defining sides 13, 13B, and a third pair of opposed length defining sides 15, 17 perpendicular to the width and height defined by the first and second pairs of opposed sides 11, 11A, 13, 13B. The container body 3 has at least one product discharge opening 9 in one side of one of the first and second pairs of opposite sides 11, 11A, 13, 13B. The cover 5 is slidably movable over the first and second pairs of opposed sides 11, 11A, 13, 13B of the container body 3 between a closed position in which the cover 5 overlies the at least one product discharge opening 9 and an open position in which the at least one product discharge opening 9 is at least partially exposed by the cover 5.

What is claimed is:

1. A packaging container for a dry granular product, the packaging container including:

a rectangular container body of folded sheet material having a-first pair of opposed sides defining a width, a second pair of opposed sides defining a height, and a third pair of opposed sides defining a length perpendicular to the width and height defined by the first and second pairs of opposed sides, and a rectangular cover of folded sheet material defining a sleeve surrounding the first and second pairs of opposed sides of the container body in sliding engagement, wherein the container body has at least one product discharge opening in one side of one of the first and second pairs of opposite sides, and wherein the cover is slidably movable between a closed position in which the cover overlies the at least one product discharge opening and an open position in which the at least one product discharge opening is at least partially exposed by the cover, wherein the cover has a partial double layer on a side confronting the one of the first pair of sides of the container having the partial double layer, and wherein the confronting partial double layers are each formed by a substantially semi-circular cut-out that extends inwardly from a free longitudinal edge of a portion of the sheet material completing the respective confronting sides of the container body and the cover.

2. The packaging container of claim 1, the at least one discharge opening is located on one side of one of the first and second pairs of opposite sides of the container body.

3. The packaging container of claim 1, wherein the at least one discharge opening is located adjacent one side of the third pair of opposite sides of the container body.

4. The packaging container of claim 1, wherein at least two opposite sides of one of the first and second pairs of opposite sides has two full layers of sheet material.

5. The packaging container of claim 4, wherein the at least two opposite sides with double layers of sheet material include the side with the at least one product discharge opening.

6. The packaging container of claim 4, wherein one side in addition to the at least two opposite sides with double layers of sheet material has a partial double layer.

7. The packaging container of claim 6, wherein the partial double layer is in one of the first pair of sides.

8. The packaging container of claim 1, wherein the container has a plurality of product discharge openings.

9. The packaging container of claim 8, wherein the plurality of discharge openings include three openings.

10. The packaging container of claim 8, wherein the plurality of product discharge openings are each circular openings.

11. The packaging container of claim 10, wherein each circular opening has a diameter of 3 millimeter.

12. The packaging container of claim 1, wherein both sides of the third pair of opposite sides has at least three full layers of sheet material.

13. The packaging container of claim 1, wherein the cover is immobilized with respect to the container body by a tamperproof seal connecting the cover to the container body.

14. The packaging container of claim 13, wherein the tamperproof seal is integrally formed as a tongue on the container body.

15. The packaging container of claim 14, wherein the tamperproof seal is connected to the one side of the third pair of opposite sides of the container body adjacent the at least one discharge opening.

16. The packaging container of claim 1, wherein the sheet material is one of paper, carton and card board having of a weight in the region of at least 310 grams per square meter.

17. The packaging container of claim 1, wherein the container body is filled with granular material.

18. The packaging container of claim 17, wherein the granular material is one of deodorant powder, sugar, salt, pepper, and spice.

19. A packaging container for a dry granular product, the packaging container including:

a rectangular container body of folded sheet material having a first pair of opposed sides defining a width, a second pair of opposed sides defining a height, and a third pair of opposed sides defining a length perpendicular to the width and height defined by the first and second pairs of opposed sides; and a rectangular cover of folded sheet material defining a sleeve surrounding the first and second pairs of opposed sides of the container body in sliding engagement, wherein the container body has at least one product discharge opening in one side of one of the first and second pairs of opposite sides, and wherein the cover is slidably movable between a closed position in which the cover overlies the at least one product discharge opening and an open position in which the at least one product discharge opening is at least partially exposed by the cover, wherein at least one side of the third pair of opposed sides has three full layers of sheet material, and wherein at least one side of the third pair of opposed sides with three full layers of sheet material has at least a partial fourth layer of sheet material.

20. The packaging container of claim 19, the at least one discharge opening is located on one side of one of the first and second pairs of opposite sides of the container body.

21. The packaging container of claim 19, wherein the at least one discharge opening is located adjacent one side of the third pair of opposite sides of the container body.

22. The packaging container of claim 19, wherein at least two opposite sides of one of the first and second pairs of opposite sides has two full layers of sheet material.

23. The packaging container of claim 22, wherein the at least two opposite sides with double layers of sheet material include the side with the at least one product discharge opening.

24. The packaging container of claim 22, wherein one side in addition to the at least two opposite sides with double layers of sheet material has a partial double layer.

25. The packaging container of claim 24, wherein the partial double layer is in one of the first pair of sides.

26. The packaging container of claim 19, wherein the container has a plurality of product discharge openings.

27. The packaging container of claim 26, wherein the plurality of discharge openings include three openings.

28. The packaging container of claim 26, wherein the plurality of product discharge openings are each circular openings.

29. The packaging container of claim 28, wherein each circular opening has a diameter of 3 millimeter.

30. The packaging container of claim 19, wherein both sides of the third pair of opposite sides has at least three full layers of sheet material.

31. The packaging container of claim 19, wherein the cover is immobilized with respect to the container body by a tamperproof seal connecting the cover to the container body.

32. The packaging container of claim 31, wherein the tamperproof seal is integrally formed as a tongue on the container body.

33. The packaging container of claim 32, wherein the tamperproof seal is connected to the one side of the third pair of opposite sides of the container body adjacent the at least one discharge opening.

34. The packaging container of claim 19, wherein the sheet material is one of paper, carton and card board having of a weight in the region of at least 310 grams per square meter.

35. The packaging container of claim 19, wherein the container body is filled with granular material.

36. The packaging container of claim 35, wherein the granular material is one of deodorant powder, sugar, salt, pepper, and spice.

* * * * *